United States Patent [19]

Aida

[11] Patent Number: 5,020,662

[45] Date of Patent: Jun. 4, 1991

[54] WRITING-UTENSIL PACKED KIT ASSEMBLY

[75] Inventor: Masaaki Aida, Tokyo, Japan

[73] Assignee: Midori, Co. Ltd., Tokyo, Japan

[21] Appl. No.: 283,264

[22] Filed: Dec. 9, 1988

[51] Int. Cl.[5] ..... A45C 11/34

[52] U.S. Cl. ..... 206/214; 206/224; 206/317; 206/815

[58] Field of Search ..... 206/214, 215, 224, 815, 206/1.7, 371

[56] References Cited

U.S. PATENT DOCUMENTS

| | | | |
|---|---|---|---|
| 752,857 | 2/1904 | Paroubek | 206/214 |
| 2,228,493 | 1/1941 | Will | 206/815 |
| 4,638,909 | 1/1987 | Ford | 206/1.7 |

FOREIGN PATENT DOCUMENTS

| | | | |
|---|---|---|---|
| 224470 | 7/1910 | Fed. Rep. of Germany | 206/214 |
| 2250208 | 4/1974 | Fed. Rep. of Germany | 206/371 |
| 1147669 | 6/1957 | France | 206/214 |
| 8683 | of 1902 | United Kingdom | 206/214 |
| 457506 | 11/1936 | United Kingdom | 206/214 |
| 938752 | 10/1963 | United Kingdom | 206/224 |

*Primary Examiner*—William I. Price

*Attorney, Agent, or Firm*—Morrison Law Firm

[57] ABSTRACT

A writing-utensil packed kit assembly comprises a body pivotally joined to a lid member so as to be openable. The lid member is laid with a mat formed of polyurethane foam, etc., and having a fingertip-inserting hole, the mat including a miniature ruler in its opening. The body includes a miniature eraser received in an end portion cut off by a partition and a suitable number of miniature writing utensils in the other portion. Male and female lid-member stoppers are formed on the peripheral edges of the body and lid member.

3 Claims, 1 Drawing Sheet

WRITING-UTENSIL PACKED KIT ASSEMBLY

BACKGROUND OF THE INVENTION

This invention relates to a novel kit assembly designed to compactly pack therein writing utensils and so on, esp., those of small size.

Heretofore, there have been available various types of writing-utensil packed kits. However, such existing writing-utensil packed kits have been only designed for writing utensils, etc. of normal sizes. Not until now has there been unavailable such a kit assembly packed with small-sized writing utensils as designed in this invention.

SUMMARY OF THE INVENTION

In view of the foregoing, an object of this invention is to provide a writing-utensil packed kit assembly in which miniature writing utensils are packed and which is very convenient to handle.

According to this invention, said object is achieved by the provision of a writing-utensil packed kit assembly comprising a body pivotally joined to a lid member so as to be openable, said lid member being provided with a mat formed of a polyurethane foam, etc., and having a fingertip-inserting hole, said mat including a miniature ruler in its opening, said body including a miniature eraser received in an end portion cut off by a partition and a suitable number of miniature writing utensils in the other portion divided by said partition, and female and male lid-member stoppers formed on the peripheral edges of said body and said lid member.

According to this invention, a suitable number of different types of miniature writing utensils, an eraser and a ruler, all heretofore unavailable, are packed in the body and the lid member in order. Thus, not only the articles packed can be utilized in a ready and fashionable manner, but the writing-utensil packed kit itself can be conveniently carried for intended or desired use.

BRIEF DESCRIPTION OF THE DRAWINGS

One writing-utensil packing kit assembly of this invention will now be described, by way of example, with reference to the accompanying drawing, in which.

DETAILED DESCRIPTION

Figure 1:
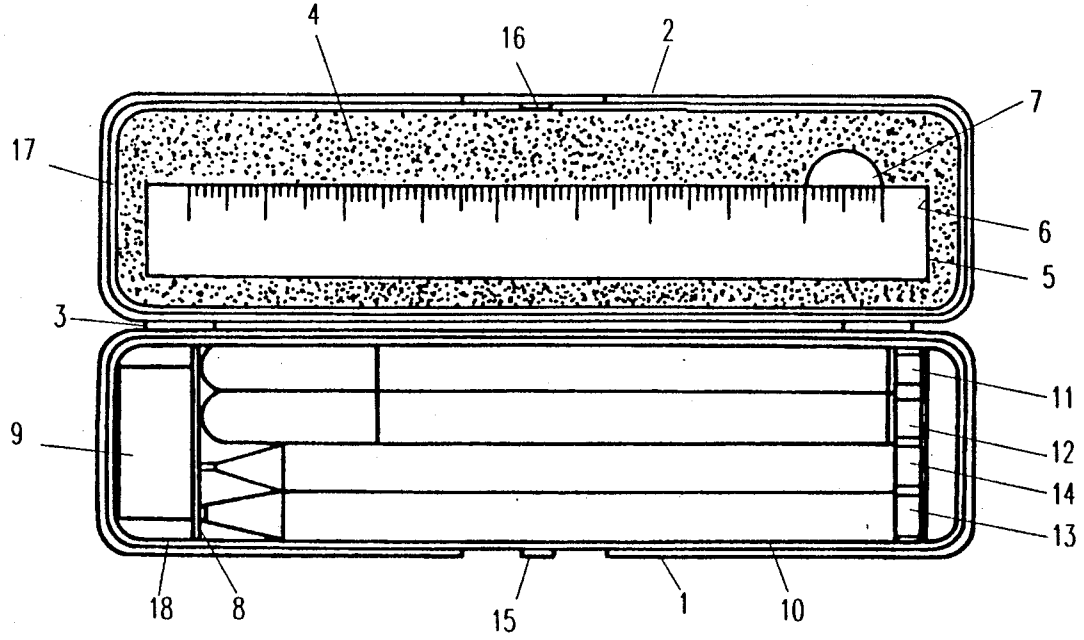
FIG. 1 is a front view of one embodiment of this invention in an open state.

The writing-utensil packed kit assembly according to this invention comprises a body 1 pivotally joined at 3 to a lid member 2 so as to be openable. Said lid member 2 is laid with a mat 4 formed of polyurethane foam, etc., which is provided with an opening portion 5 for detachably receiving a miniature ruler 6. It is to be noted that reference numeral 7 stands for a fingertip-inserting hole for ready removal of the ruler.

Said body 1 includes a miniature eraser 9 received in an end portion cut off by a partition 8 and a suitable number of miniature writing utensils 10 in the other portion divided by the partition 8. By way of example, two marking pens 11, 12 of different colors, a knocking type ball-point pen 13 and a mechanical pencil 14 may be packed in the body 1, as illustrated.

It is to be noted that reference numerals 15 and 16 stand for female and male lid-member stoppers formed on the edges of the body 1 and the lid member 2.

While this invention has been described, specifically but not exclusively, with reference to one embodiment, various modifications and changes may be made within the purport as defined in the appended claims. For instance, a female recess 17 and a male projection 18 may be formed on the peripheral edges of the body 1 and the lid member 2. Although not otherwise illustrated, a plurality of small pieces may be formed on the bottoms of the writing utensils packed in the body so as to prevent them from moving crosswise.

According to this invention, a suitable number of different types of miniature writing utensils 10, eraser 9 and ruler 9, all heretofore unavailable, are packed in the body 1 and the lid member 2 in order. Thus, not only the articles packed cannot be utilized in a ready and fashionable manner, but the writing-utensil packed kit itself can be conveniently carried for intended or desired use.

What is claimed is:

1. A writing-utensil packed kit assembly comprising a body hingedly joined to a lid member so as to be openable, said body having two pairs of opposed, parallel, substantially straight sides, said sides meeting in rounded corners.

said lid member being congruent with said body, said lid member being laid with a mat formed of a foam material, said mat having an opening adapted to releasably receive a miniature ruler and having a fingertip-inserting hole adjacent said opening, said mat including a miniature ruler received in said opening, said body having a first straight, transverse partition defining therein a first portion including two of said rounder corners and including a miniature eraser received in said first portion, and a second straight, transverse partition, parallel to said first partition, defining a second, rectangular portion, and a plurality of miniature writing utensils disposed in said second portion, said utensils each being of a length equal to the length of said second portion and a combined width equal to the width of said second portion, and mating female and male latch members formed on the peripheral edges of said body and said lid member.

2. A kit assembly according to claim 1, wherein said writing utensils comprise two marking pens of different colors, a retractable type ball-point pen and a mechanical pencil.

3. A kit assembly according to claims 1 or 2, wherein an annular female recess and a mating male projection are formed on said peripheral edges of said body and said lid member.

* * * * *